US007809311B2

(12) United States Patent
Casella et al.

(10) Patent No.: US 7,809,311 B2
(45) Date of Patent: Oct. 5, 2010

(54) CAMMING METHOD AND APPARATUS FOR CONTROLLING COLOR DEVELOPERS FOR NON-CONTACT DEVELOPMENT

(75) Inventors: James M. Casella, Webster, NY (US); Roger D. Masham, Ashwell (GB); Andrew E. Taylor, Hitchin (GB); Jeremy B. Lewis, London (GB); Peter J. Keilty, Welwyn Garden City (GB)

(73) Assignee: Xerox Corporation, Norwalk, CT (US)

( * ) Notice: Subject to any disclaimer, the term of this patent is extended or adjusted under 35 U.S.C. 154(b) by 464 days.

(21) Appl. No.: 11/846,245

(22) Filed: Aug. 28, 2007

(65) Prior Publication Data

US 2009/0060592 A1 Mar. 5, 2009

(51) Int. Cl.
*G03G 15/01* (2006.01)

(52) U.S. Cl. ..... 399/228

(58) Field of Classification Search ..... 399/228, 399/279, 223, 222

See application file for complete search history.

(56) References Cited

U.S. PATENT DOCUMENTS

| | | | | |
|---|---|---|---|---|
| 4,746,951 | A * | 5/1988 | Hayakawa et al. | 399/119 |
| 4,801,966 | A * | 1/1989 | Ikeda | 399/228 |
| 4,939,547 | A * | 7/1990 | Miyaji et al. | 399/228 |
| 4,954,844 | A * | 9/1990 | Morita et al. | 399/224 |
| 5,250,987 | A * | 10/1993 | Gern | 399/226 |
| 2003/0147672 | A1 * | 8/2003 | Ahn | 399/228 |

* cited by examiner

*Primary Examiner*—David M Gray
*Assistant Examiner*—Billy J Lactaoen
(74) *Attorney, Agent, or Firm*—Oliff & Berridge, PLC

(57) ABSTRACT

A developer camming apparatus connected to a developer unit, including a slide, a motor, and an encoder, wherein the encoder determines a distance a developer unit is from the photoreceptor, wherein the encoder allows the developer unit to be sufficiently close to effect application of toner to the photoreceptor from the developer unit, but also does not allow the developer unit to contact the photoreceptor during a print job.

15 Claims, 1 Drawing Sheet

CAMMING METHOD AND APPARATUS FOR CONTROLLING COLOR DEVELOPERS FOR NON-CONTACT DEVELOPMENT

BACKGROUND

The present disclosure relates to a marking device, in particular a developer camming apparatus for a two-pass, multi-color electrophotographic printer, and to a method of two-pass multi-color electrophotographic printing using a developer camming apparatus.

The developer camming apparatus of the present disclosure allows a document to be printed without the need of a developer unit contacting a photoreceptor in order to apply toner. Further, each developer unit contains a developer camming apparatus, which provides each developer unit independent positioning control allowing each developer unit the ability to move in opposite directions of each other, that is, toward the photoreceptor or away from the photoreceptor, with independent timing.

The methods and apparatus herein thus have utility in eliminating transient force placed on the photoreceptor, thereby improving motion quality and image quality.

Electrophotographic marking is a well-known and commonly used method of copying or printing documents. Electrophotographic marking is performed by exposing a light image representation of a desired document onto a substantially uniformly charged photoreceptor. In response to that light image, the photoreceptor discharges so as to create an electrostatic latent image of the desired document on the photoreceptor's surface. Toner particles are then deposited onto that latent image so as to form a toner image. That toner image is then transferred from the photoreceptor onto a substrate such as a sheet of paper. The transferred toner image is then fused to the substrate, usually using heat and/or pressure. The surface of the photoreceptor is then cleaned of residual developing material and recharged in preparation for the production of another image.

Electrophotographic marking produces color images by repeating the above process once for each color of toner that is used to make the composite color image. For example, in a one-color process, a charged photoreceptive surface is exposed to a light image, which represents a first color, for example black. The resulting electrostatic latent image is then developed with black toner particles to produce a black toner image. For multi-color processes, the charge, expose, and develop process is repeated for a second color, for example yellow, then for a third color, for example magenta, and finally for a fourth color, for example cyan. The various color toner particles are placed in superimposed registration so that a desired composite color image results. That composite color image is then transferred and fused onto a substrate.

The above process can be implemented in various ways. For example, in a two-pass marking device, the composite final image is produced in two-passes of the substrate by the photoreceptor through the machine where only one color toner image is produced during each pass by the photoreceptor through the marking device. A second implementation may be a four-pass printer where only one color toner image is produced during each pass by the photoreceptor through the machine.

Typical developer units include camming mechanisms that bring each developer unit into contact with spacers that are set between the developer and the photoreceptor at a predetermined distance. However, contact with the photoreceptor may produce transient force causing the photoreceptor to bend, which affects motion quality and image quality. Current developer camming mechanisms attempt to solve this problem by either 1) minimizing the force placed on the photoreceptor by a developer unit, that is, the force applied to a photoreceptor is minimized as a developer unit makes contact with a spacer, or 2) keeping the force placed on the photoreceptor constant, that is, just as one developer unit starts to move away from a spacer and the photoreceptor, another developer unit moves into contact with a spacer that is between the photoreceptor and the developer, thus maintaining a constant force against the photoreceptor.

However, as mentioned above, developer camming mechanisms may cause transient force to a photoreceptor, and therefore affect motion quality and image quality.

SUMMARY

A need therefore exists for an improved developer camming mechanism that eliminates force applied to a photoreceptor during a printing process.

In embodiments, described is a developer camming apparatus connected to a developer unit, including a slide, a motor, and an encoder, wherein the encoder allows the developer unit to be sufficiently close to effect application of toner to the photoreceptor from the developer unit, but also does not allow the developer unit to contact the photoreceptor during a print job.

In further embodiments, described is a marking device, including at least one photoreceptor, a first developer unit for developing a first latent image with a first toner contained in the first developer unit to produce a first toner image on the photoreceptor, at least a second developer unit for developing a second latent image with a second toner contained within the second developer unit to produce a second toner image on the photoreceptor, a first developer camming apparatus connected to the first developer unit, and at least a second developer camming apparatus connected to the second developer unit, wherein each of the first and second developer camming apparatuses include a slide, a motor, and an encoder, wherein the encoder allows the developer unit to be sufficiently close to effect application of toner to the photoreceptor from the developer unit, but also does not allow the developer unit to contact the photoreceptor during a print job.

In still further embodiments, described a method of generating a printed document from a marking device that includes a first developer unit connected to a first developer camming apparatus and at least a second developer unit connected to a second developer camming apparatus, each developer unit associated with a same photoreceptor, including receiving a request to print a document, determining which developer unit of the first developer unit and the second developer unit is first needed to print a portion of the document, moving the first needed one of the first or the second developer unit sufficiently close to effect application of toner to the photoreceptor, not allowing the needed one of the first or the second developer unit to contact the photoreceptor during development, and moving the other of the first or the second developer unit away from the photoreceptor. Further, determining if the other of the first or the second developer unit is needed to print a portion of the document, and if so, moving the other of the first or the second developer unit sufficiently close to effect application of toner to the photoreceptor, not allowing the other of the first or second developer unit to contact the photoreceptor during development, and moving the first needed on of the first or the second developer unit away from the photoreceptor, and printing onto the photorecptor the other of the first or the second developer unit and/or the needed one of the first or the second developer unit.

BRIEF DESCRIPTION OF THE DRAWINGS

The FIGURE is a diagram showing the basic elements of a developer camming mechanism in accordance with the present disclosure.

EMBODIMENTS

Figure 1:
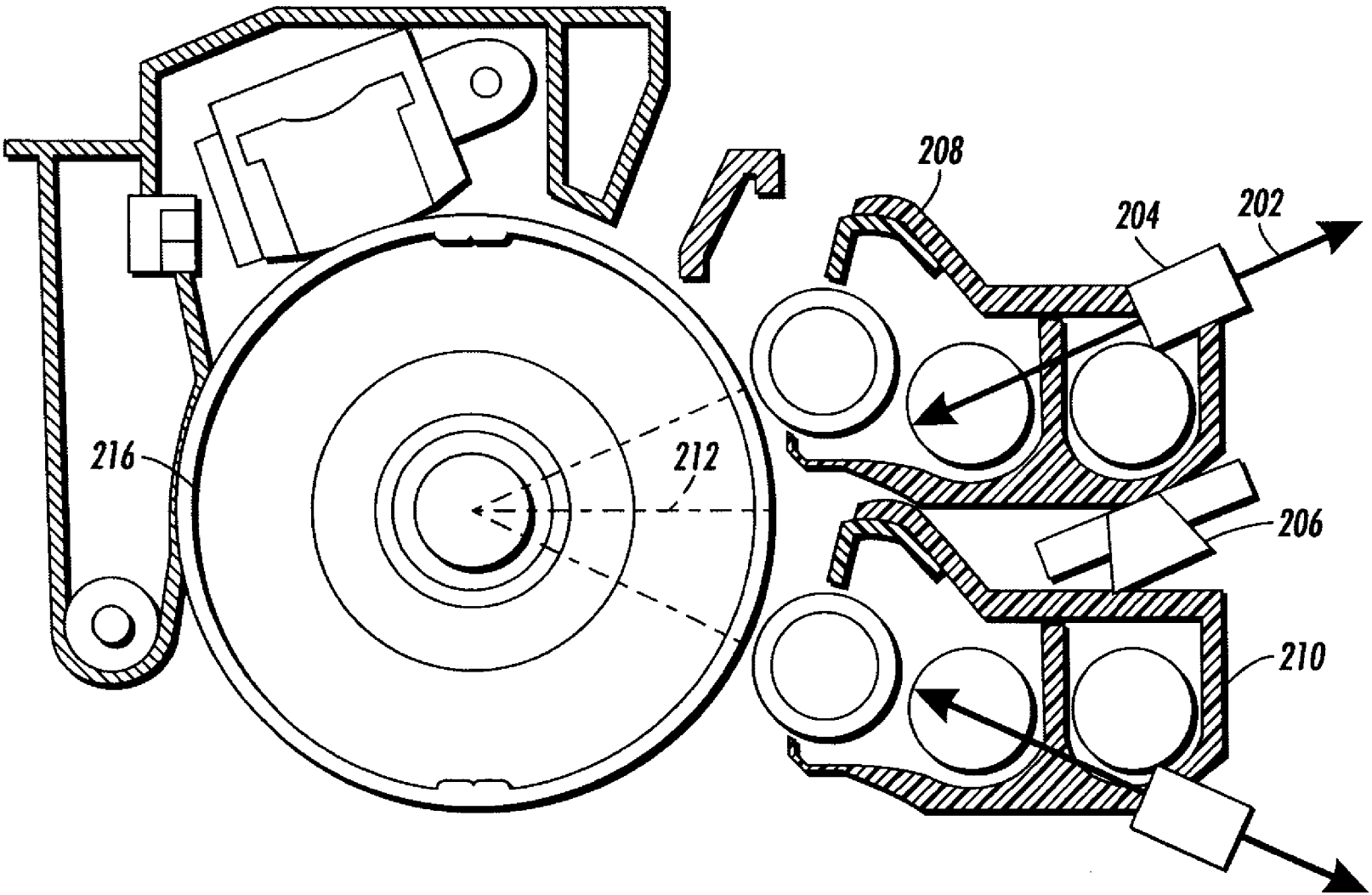

Although a xerographic "laser printer" is described herein, it will be understood that the present disclosure can be applied to any type of digital printing apparatus.

In embodiments, a device may include a marking engine, which includes hardware by which image signals are used to create a desired image, as well as a feeder module, which stores and dispenses sheets on which images are to be printed, and an optional finisher, which may include hardware for stacking, folding, stapling and binding prints which are output from the marking engine. If the device is also operable as a copier, the device further includes a document feeder, which operates to feed a document with an original image to an imaging station, for example, with a platen, where the original image is converted into digital signals, which are in turn processed to create copies with the marking engine. The device may also include a local user interface for controlling its operations, although another source of image data and instructions may include any number of computers to which the device is connected via a network.

The feeder module may include any number of trays, each of which stores print sheets ("stock") of a predetermined type, such as size, weight, color, coating, transparency, and includes a feeder to dispense one of the sheets therein as instructed. Certain types of stock may require special handling in order to be dispensed properly. For example, heavier or larger stocks may desirably be drawn from a stack by use of an air knife, fluffer, vacuum grip or other application (not shown) of air pressure toward the top sheet or sheets in a stack. Certain types of coated stock are advantageously drawn from a stack by the use of an application of heat, such as by a stream of hot air (not shown). Sheets drawn from a selected tray are then moved to the marking engine to receive one or more images thereon.

In embodiments, the marking engine is an electrophotographic type engine, and specifically for forming color images, although engines for making black images may also be used. An electrophotographic type color type engine typically may use different colors in multiple developer units, for example, cyan, magenta, yellow and black. The marking engine includes at least two developer units where each developer unit contains a different color toner, for example, cyan, magenta, yellow or black. Therefore, in a two-pass marking device containing only two developer units, a composite final image is produced in two-passes of the substrate by the photoreceptor where one color toner image is produced during a first pass by a first developer unit and a second color toner image is produced during a second pass by a second developer unit. Thus, each developer unit includes a developer camming mechanism (explained in detail below) for alternately engaging each developer unit with a photoreceptor in order to apply toner.

The marking engine includes at least one photoreceptor. The photoreceptor may be what can be called a "rotatable image receptor," meaning any rotatable structure such as a drum or belt which can temporarily retain one or more latent and/or developer images for printing may be used. The photoreceptor is entrained on a number of rollers, and a number of stations familiar in the art of xerography may be placed suitably around the photoreceptor, such as a charging station for charging photoreceptor, an imaging station for exposing photoreceptor to produce latent images on photoreceptor, developer units and for developing the latent images with toner to produce a toner image on photoreceptor, and a transfer station for transferring the toner image from photoreceptor onto a substrate. Therefore, in a two-pass marking device, the developer units and individually produce a latent image of a color toner on respective passes. For example, one developer unit may apply, for example, yellow toner to the photoreceptor on the first pass, and the other developer unit may apply black toner to the photoreceptor on the second pass. In embodiments, the marking engine may contain more than one photoreceptor. In further embodiments, each photoreceptor contains two developer units, each developer unit containing a developer camming mechanism.

FIG. 1 is a diagram showing the basic elements of a developer camming mechanism in accordance with the present disclosure. With respect to developer unit 208, the developer camming mechanism includes a slide 202, a motor 204, and an encoder 206. For clarity, the developer camming mechanism is only shown on developer unit 208. However, in practice, the developer camming mechanism may also be included on developer unit 210.

As shown in FIG. 1, developer unit 208 is mounted on slide 202. The Slide 202 may be set at about a 23° angle above the horizontal centerline 212 and developer unit 210 is mounted on a slide (not shown) at about a 23° angle below the horizontal centerline 212. However, a slide angle may be adjusted to any desired angle as long as the application of toner from the developer unit mounted on the slide is still achieved. For example, a slide may be set at about a 20° angle to about a 30° angle above a horizontal centerline 212, and developer unit 210 may be mounted on a slide (not shown) at about a 20° angle to about a 30° below the horizontal centerline 212. The difference in the slide angle will vary depending on, for example, the number of components surrounding the photoreceptor. The more components, the more crowded a certain area may be, and therefore, the slide may need to be a particular angle to fit among the other components. In contrast, if there are few components surrounding the photoreceptor, the less crowded an area may be, and therefore, there will not be much restriction on the slide angle.

Utilizing motor 204 attached to developer unit 208, slide 202 allows developer unit 208 to move smoothly at a desired angle toward and away from a photoreceptor 216, as well as stopping without sudden jerks which interfere with printing. Further, this allows for independent positioning and control of each developer unit, and thus each developer unit can be moved sequentially in opposite directions with independent timing. In embodiments, system software provides motor 204 with instructions as to what direction to move developer unit 208 and at what rate to move a developer unit 208. In further embodiments, slide 202, motor 204 and encoder 206 may be one unit and/or circuit.

Unlike previous developer camming mechanisms that place force on a photoreceptor, the developer camming mechanism prevents developer unit 208 from contacting photoreceptor 216 during a print job by regulating the distance between developer unit 208 and photoreceptor 216. Therefore, while keeping a gap between the developer unit 208 and photoreceptor 216 is important for eliminating transient force placed on photoreceptor 216, knowing the distance between developer unit 208 and photoreceptor 216 is critical for printing with a desired toner and not printing an unwanted toner. For example, a developer unit needs to be closer to a photoreceptor to print a desired color of toner, and in the alternative, a developer unit needs to be further away from a photoreceptor to not print an unwanted color of toner.

Upon receipt of a request to print a document, marking engine determines what developer units are needed in order to print the document. Currently, as mentioned above, developer units contact a photoreceptor in order to apply a desired toner. However, this contact produces transient force on the photoreceptor, which may cause the photoreceptor to bend, affecting motion quality and image quality. To eliminate transient force placed on the photoreceptor, and thereby improving motion quality and image quality, a developer unit of the present disclosure does not contact the photoreceptor during a print process. Therefore, when toner within developer unit 208, for example, is desired to be used to print a portion of the document, system software instructs encoder 206 to set the distance between developer unit 208 and photoreceptor 216 in such a way as to allow developer unit 208 to apply toner without developer unit 208 contacting photoreceptor 216. In embodiments, encoder 206 keeps the developer unit 208 a distance of from about 1 mm to about 0.025 mm away from the photoreceptor during development. In further embodiments, encoder 206 keeps the developer unit 208 a distance of from about 0.325 to about 0.025 mm away from the photoreceptor during development.

In embodiments, the distance developer unit 208 needs to be from photoreceptor 216 to disable application of toner to the photoreceptor 216 is from about 1.25 mm to about 1.5 mm. In further embodiments, the distance developer unit 208 needs to be from photoreceptor 216 to disable application of toner to the photoreceptor 216 is from about 1.25 mm to about 1.35 mm. Furthermore, because developer 208 is needed at that moment and developer 210 is not, developer 210 is moved away from photoreceptor 216. Encoder 206 is attached to developer unit 208 to determine a distance developer unit 208 is from photoreceptor 216.

To provide distance information, encoder 206 must first establish an initial distance that developer unit 208 is from photoreceptor 216. In embodiments, this initial distance may be established during manufacturing setup. The manufacturing setup designed to establish the initial distance a developer unit is from a photoreceptor will be referred to as a gap tool. The gap tool provides a frame of reference for encoder 206 regarding the distance developer unit 208 is from photoreceptor 216. For example, once the gap tool establishes an initial distance the developer unit 208 is from photoreceptor 216, encoder 206 is set to "0." Thus, because encoder 206 is attached to developer 208, encoder 206 now knows the distance developer 208 is from photoreceptor 216 and can now instruct developer unit 208 to move a desired distance from photoreceptor 216 with a degree of certainty.

In embodiments, the gap tool may be placed at the end of developer unit 208 or on photoreceptor 216 to provide instructions to encoder 206 as to what distance developer unit 208 is from photoreceptor 216. In further embodiments, the gap tool may be stored within encoder 206. The initial distance developer unit 208 is from photoreceptor 216 is stored in, for example, non-volatile memory. Therefore, upon power off or at an end of a print job, a new distance determination is not needed.

It will be appreciated that various of the above-disclosed and other features and functions, or alternatives thereof, may be desirably combined into many other different systems or applications. Also, it will be appreciated that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A developer camming apparatus connected to a developer unit, comprising:

a slide that is attached to the developer unit and the slide mounted at about a 20° angle to about a 30° angle above a horizontal center line of a photoreceptor;

a motor; and an encoder;

wherein the encoder allows the developer unit to move along the slide to be sufficiently close to the photoreceptor to effect application of toner to the photoreceptor from the developer unit, and does not allow the developer unit to contact the photoreceptor during the application of toner.

2. The developer camming apparatus of claim 1, wherein the encoder determines a distance the developer unit is from the photoreceptor.

3. The developer camming apparatus of claim 1, wherein the encoder keeps the developer unit a distance of from about 1 mm to about 0.025 mm away from the photoreceptor during the application of toner.

4. The developer camming apparatus of claim 1, wherein the encoder keeps the developer unit a distance of from about 0.325 mm to about 0.025 mm away from the photoreceptor during the application of toner.

5. A marking device, comprising:

at least one photoreceptor;

a first developer unit for developing a first latent image with a first toner contained in the first developer unit to produce a first toner image on the photoreceptor;

at least a second developer unit for developing a second latent image with a second toner contained within the second developer unit to produce a second toner image on the photoreceptor;

a first developer camming apparatus connected to the first developer unit; and at least a second developer camming apparatus connected to the second developer unit;

wherein the first developer camming apparatus and the second developer camming apparatus each comprise:

a slide attached to a respective one of the first developer unit and the second developer unit;

a motor; and an encoder;

wherein the encoder allows a respective camming apparatus to move the respective developer unit along the slide to a position sufficiently close to the at least one photoreceptor to effect application of toner to the at least one photoreceptor from the respective developer unit, and does not allow the respective developer unit to contact the photoreceptor during the application of toner, and wherein the slide attached to the first developer unit is set at about a 20° angle to about a 30° angle above a horizontal center line of the photoreceptor, and the slide attached to the second developer unit is set at about a 20° angle to about a 30° angle below the horizontal center line of the photoreceptor.

6. The marking device of claim 5, wherein each photoreceptor of the at least one photoreceptor is associated with two developer units.

7. The marking device of claim 5, wherein the encoder keeps each developer unit a distance of about 1 mm to about 1.35 mm away from the at least one photoreceptor when each developer unit is not needed for the application of toner.

8. The marking device of claim 5, wherein the encoder keeps each developer unit a distance of from about 1 mm to about 0.025 mm away from the photoreceptor during the application of toner.

9. The marking device of claim 4, wherein the encoder keeps each developer unit a distance of from about 0.325 mm to about 0.025 mm away from the at least one photoreceptor during the application of toner.

10. A method of generating a printed document from a marking device that includes a first developer unit connected to a first developer camming apparatus and at least a second developer unit connected to a second developer camming apparatus, each developer unit being associated with a same photoreceptor, comprising:

receiving a request to print a document;

determining which developer unit of the first developer unit and the second developer unit is first needed to print a portion of the document;

moving the first needed one of the first developer unit or the second developer unit sufficiently close to the photoreceptor to effect application of toner to the photoreceptor, not allowing the needed one of the first or the second developer unit to contact the photoreceptor during the application of toner to the photoreceptor, and moving the other of the first developer unit or the second developer unit away from the photoreceptor;

determining if the other of the first or the second developer unit is needed to print another portion of the document, and if so, moving the other of the first developer unit or the second developer unit sufficiently close to the photoreceptor to effect application of toner to the photoreceptor, not allowing the other of the first developer unit or second developer unit to contact the photoreceptor during the application of toner to the photoreceptor, and moving the first needed one of the first developer unit or the second developer unit away from the photoreceptor; and printing an image onto the photoreceptor using the other of the first developer unit or the second developer unit and/or the needed one of the first developer unit or the second developer unit, wherein each developer camming apparatus includes a slide attached to a respective one of the first developer unit and the second developer unit, wherein the slide attached to the first developer unit is set at about a 20° angle to about a 30° angle above a horizontal center line of the photoreceptor, and the slide attached to the second developer unit is set at about a 20° angle to about a 30° below the horizontal center line of the photoreceptor.

11. The method of claim 10, wherein the first developer camming apparatus includes a first encoder for determining a distance the first developer unit is from the photoreceptor and the second developer camming apparatus includes a second encoder for determining a distance the second developer unit is from the photoreceptor.

12. The method of claim 10, wherein the printing comprises a two-pass printing process wherein a substrate is made to pass twice by the developer units, comprising:

in a first pass, moving the first needed one of the first developer unit or the second developer unit sufficiently close to the photoreceptor to effect application of toner to the photoreceptor, not allowing the first needed one of the first developer unit or the second developer unit to contact the photoreceptor during the application of toner, and moving the other of the first or the second developer unit away from the photoreceptor; and in a second pass, moving the needed one of the first developer unit or the second developer unit away from the photoreceptor, and moving the other of the first developer unit or the second developer unit sufficiently close to the photoreceptor to effect application of toner to the photoreceptor, not allowing the other of the first developer unit or the second developer unit to contact the photoreceptor during the application of toner.

13. The method of claim 12, wherein the first encoder does not allow the first developer unit to contact the photoreceptor during the application of toner, and the second encoder does not allow the second developer unit to contact the photoreceptor during the application of toner.

14. The method of claim 13, wherein the first encoder attached to the first developer camming apparatus keeps the first developer unit a distance of from about 1 mm to about 0.025 mm away from the photoreceptor during the application of toner, and the second encoder attached to the second developer camming apparatus keeps the second developer unit a distance of from about 1 mm to about 0.025 mm away from the photoreceptor during the application of toner.

15. The method of claim 13, wherein the first encoder attached to the first developer camming apparatus keeps the first developer unit a distance of from about 0.325 mm to about 0.025 mm away from the photoreceptor during the application of toner, and the second encoder attached to the second developer camming apparatus keeps the second developer unit a distance of from about 0.325 mm to about 0.025 mm away from the photoreceptor during the application of toner.

* * * * *